US005447270A

United States Patent [19]

McNown

[11] Patent Number: 5,447,270

[45] Date of Patent: Sep. 5, 1995

[54] LAMINATIONS FOR IMPROVED CONTAINER COMPRESSIVE STRENGTH

[75] Inventor: William J. McNown, Covington, Va.

[73] Assignee: Westvaco Corporation, New York, N.Y.

[21] Appl. No.: 359,934

[22] Filed: Dec. 22, 1994

Related U.S. Application Data

[63] Continuation of Ser. No. 178,896, Jan. 7, 1994, abandoned.

[51] Int. Cl.[6] ..... B65D 5/42

[52] U.S. Cl. ..... 229/199; 229/919; 229/930; 229/939

[58] Field of Search ..... 229/132, 166, 199, 919, 229/930, 939

[56] References Cited

U.S. PATENT DOCUMENTS

| | | | |
|---|---|---|---|
| 1,022,923 | 4/1912 | Bird | 229/199 |
| 1,160,760 | 11/1915 | Rexford | 229/199 |
| 1,218,872 | 3/1917 | Lafore | 229/199 |
| 1,417,776 | 5/1922 | Shafer | 229/199 |
| 1,524,292 | 1/1925 | Dinsmoor . | |
| 1,527,021 | 2/1925 | Wandel . | |
| 1,555,182 | 9/1925 | Bulis | 229/939 |
| 1,600,396 | 9/1926 | Campbell et al. | 229/199 |
| 1,631,521 | 6/1927 | Crowell | 229/939 |
| 1,827,334 | 10/1931 | Rider . | |
| 1,827,442 | 10/1931 | Stokes . | |
| 1,912,698 | 6/1933 | Fersman | 229/939 |
| 2,330,294 | 9/1943 | Leavitt et al. | 229/199 |
| 2,391,791 | 12/1945 | McHenry | 229/939 |
| 2,454,573 | 11/1948 | Scher . | |
| 2,676,745 | 4/1954 | Geisler . | |
| 2,710,134 | 6/1955 | Schoeder et al. | 229/939 |
| 2,933,228 | 4/1960 | Guyer . | |
| 3,355,081 | 11/1967 | Kachurchak | 229/199 |
| 3,520,468 | 7/1970 | Wiemann . | |
| 3,883,067 | 5/1975 | McGlynn et al. . | |
| 3,955,746 | 5/1976 | Engman . | |
| 4,056,223 | 11/1977 | Williams . | |
| 4,059,220 | 11/1977 | Lorenz . | |
| 4,655,366 | 4/1987 | Sykes . | |
| 4,718,597 | 1/1988 | Bishop . | |
| 4,804,138 | 2/1989 | McFarland . | |
| 4,905,864 | 3/1990 | Balin | 229/939 |
| 5,256,427 | 10/1993 | Quick et al. . | |

FOREIGN PATENT DOCUMENTS

| | | | |
|---|---|---|---|
| 687950 | 6/1964 | Canada | 229/199 |
| 752229 | 9/1933 | France | 229/199 |
| 2037226 | 7/1980 | United Kingdom | 229/939 |

OTHER PUBLICATIONS

Container Corporation of America Handbook, Fibre Box Ass., 1974, p. 22.

*Primary Examiner*—Gary E. Elkins
*Attorney, Agent, or Firm*—J. R. McDaniel; R. L. Schmalz

[57] ABSTRACT

This invention relates to improvements in the top-to-bottom compressive strength of corrugated fiber containers through the use of a minimum amount of extra fiber. Such structures of this type, generally, employ strip and patch laminations which provide minimal additional fiber and maximal reinforcement in the areas of the corrugated container panels that are under the highest compressive stresses when the containers are subjected to compressive loads.

8 Claims, 10 Drawing Sheets

FIG. 1 DIMENSIONS FOR PANELS WITH FLAPS
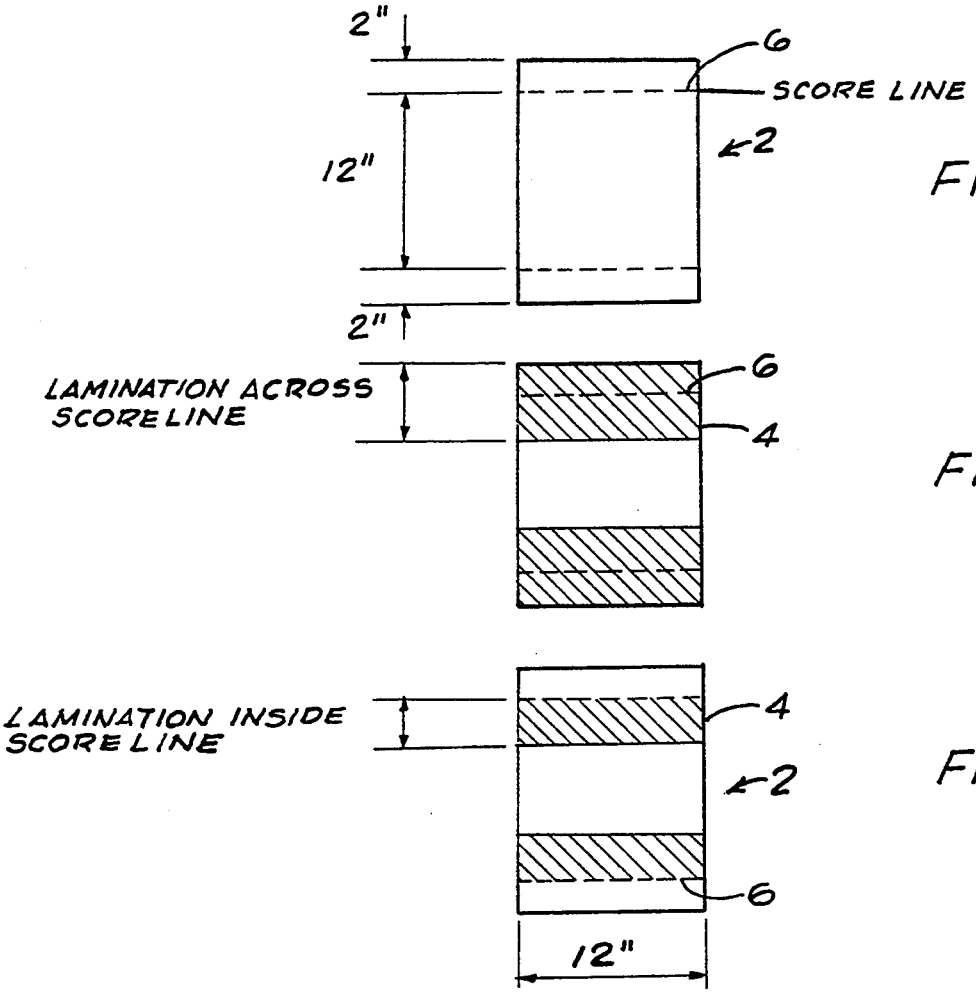
FIG. 1a
FIG. 1b
FIG. 1c
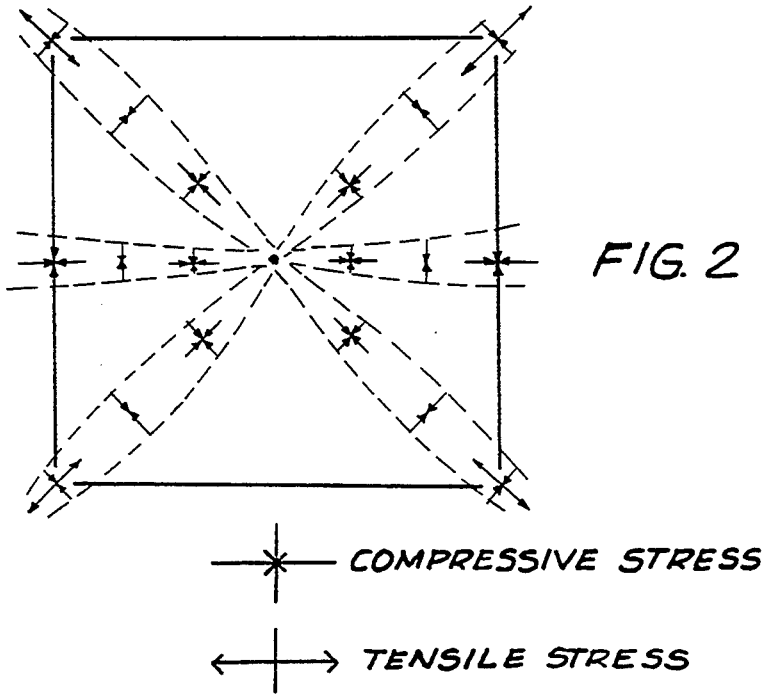
FIG. 2

LAMINATIONS FOR IMPROVED CONTAINER COMPRESSIVE STRENGTH

This application is a Continuation of application Ser. No. 08/178,896, filed Jan. 7, 1994, abandoned.

BACKGROUND OF THE INVENTION

1. Field of the Invention

This invention relates to improvements in the top-to-bottom compressive strength of corrugated fiber containers through the use of a minimum amount of extra fiber. Such structures of this type, generally, employ strip and patch laminations which provide minimal additional fiber and maximal reinforcement in the areas of the corrugated container panels that are under the highest compressive stresses when the containers are subjected to compressive loads.

2. Description of the Related Art

It is known, in the container art to employ strips located along the score lines to reinforce the score lines. Such prior art containers are disclosed in U.S. Pat. No. 1,524,292, to P. A. Dinsmoor, entitled "Box." The Dinsmoor patent teaches the use of reinforcing strips which are pasted along the score lines of the box in order to provide reinforcement along the score lines. Also, corner reinforcements between the side panels are provided in order to protect the box against collapsing when weight is piled on. While these reinforcing strips protect the score lines and the side panels, it is well known that the highest compressive stresses located in a box, when other boxes are piled on top, are located in corners of the box where the side panels meet the upper and lower panels. Therefore, a more advantageous container would be presented if the reinforcements could be located in the corners where the highest compressive stresses are located.

It is also known in the prior art to employ the use of reinforced corners in order to alleviate substantial compressive forces in the containers, which in the past have frequently caused collapse and severe distortion of the lower containers resulting in accidental exposure of the product contained therein. Such prior art is disclosed in U.S. Pat. No. 4,056,223, ('223) to M. M. Williams, entitled "Foldable Container and Blank Thereof." While the ('223) reference does employ the use of corner reinforcements, due to the nature of the blank produced by the ('223) reference, the blank must be setup, folded, glued, packed and folded again in order to fill and ship the box with the desired goods. It is clear from the discussion in the ('223) reference that specialized equipment would be needed in order to fill and ship the container. Typically, a customer who receives blanks from a blank producer only has to pack and fold the container in order to ship the customer's goods. Therefore, a still more advantageous container would be provided if the container included reinforced critical corner components while at the same time avoided the use of specialized equipment in order to pack and ship the container.

It is apparent from the above, there exists a need in the art for a container which is lightweight through simplicity of parts and uniqueness of structure, and which is able to accommodate the compressive stresses located in the corners of the container, but which at the same time does not require specialized equipment in order to pack and ship the container. It is the purpose of this invention to fulfill this and other needs in the art in a manner more apparent to the skilled artisan once given the following disclosure.

SUMMARY OF THE INVENTION

Generally speaking, this invention fulfills these needs by providing a foldable corrugated container, wherein said foldable container is comprised of: a corrugated blank having first and second edges, a plurality of flaps located substantially along said first and second edges, and first and second score lines such that said first score lines are located substantially parallel to said first and second edges and said second score lines are located substantially normal to said first and second edges; and a plurality of paperboard laminatins located substantially adjacent to said laminations substantially increase the compressive strength of said container.

In certain preferred embodiments, the corrugated material is corrugated paperboard. Also, the laminations may instead be located substantially along the first score lines. Finally, the laminations may be in the form of strips or patches.

In another further preferred embodiment, the compressive strength of the container is substantially improved through the use of the strip or patch laminations because the laminations improve the transfer of compressive loads into the container panels.

The preferred container, according to this invention, offers the following advantages: ease of assembly; improved compressive strength characteristics; good stability; good durability; and excellent economy. In fact, in many of the preferred embodiments, these factors of ease of assembly, improved compressive strength, and excellent economy are optimized to an extent that is considerably higher than heretofore achieved in prior, known containers.

BRIEF DESCRIPTION OF THE DRAWING

The above and other features of the present invention, which will become more apparent as the description proceeds, are best understood by considering the following detailed description in conjunction with the accompanying drawings, wherein like characters represent like parts throughout the several views and in which:

FIGS. 1A to 1C are schematic illustrations of container panels having no laminations, laminations across the score lines, and laminations inside the score lines, respectively, according to the present invention:

FIG. 2 illustrated stresses in a corrugated container panel subjected to top-to-bottom compression;

DETAILED DESCRIPTION OF THE INVENTION

Figure 3C:
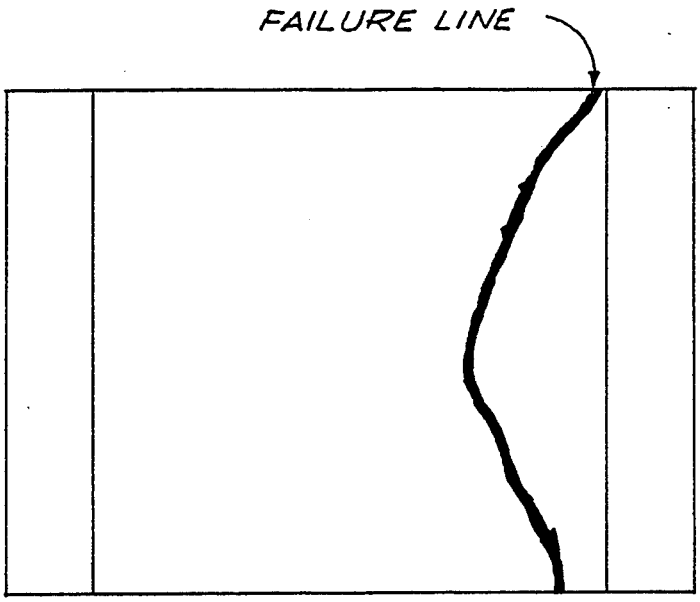
FIGS. 3A to 3C illustrate full width laminatins of panels with flaps for various panel constructions, according to the present invention.
Figure 3B:
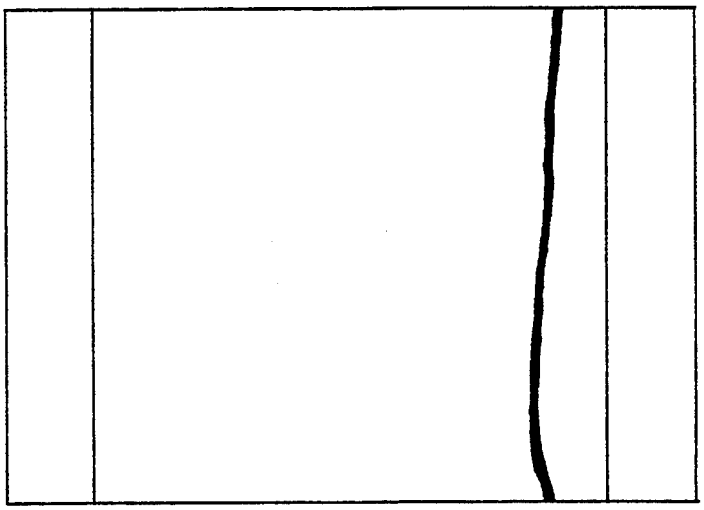
Figure 3A:
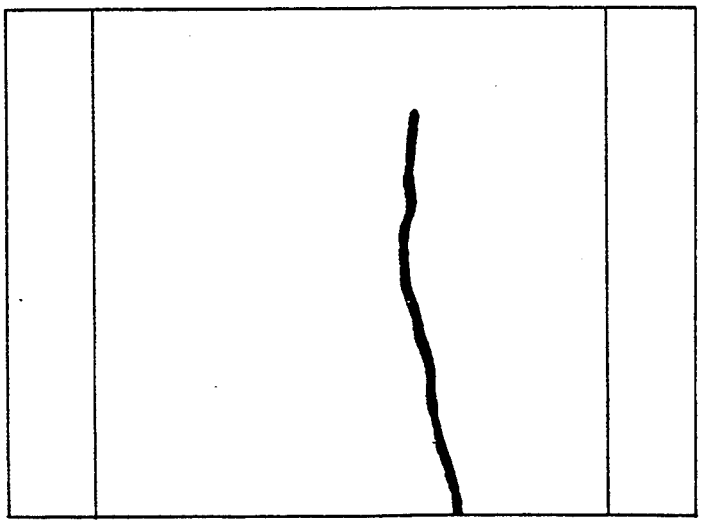
Figure 4C:
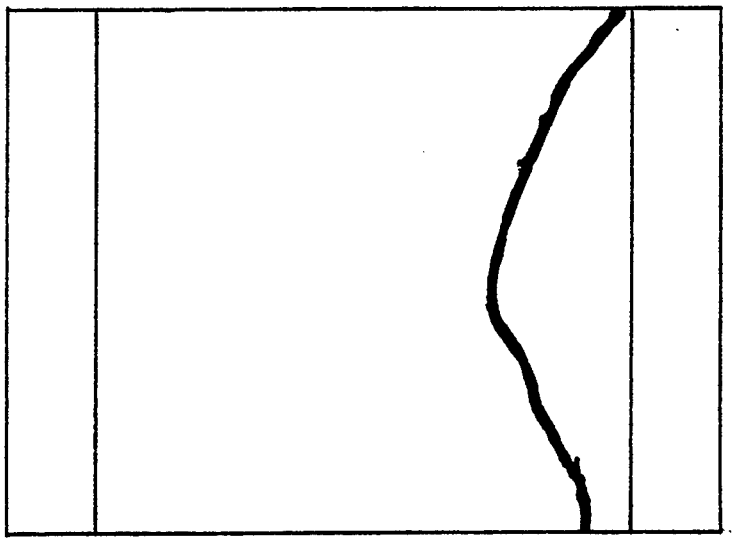
FIGS. 4A to 4C illustrate laminations across score lines on panels with flaps for various panel constructions, according to the present invention.
Figure 4B:
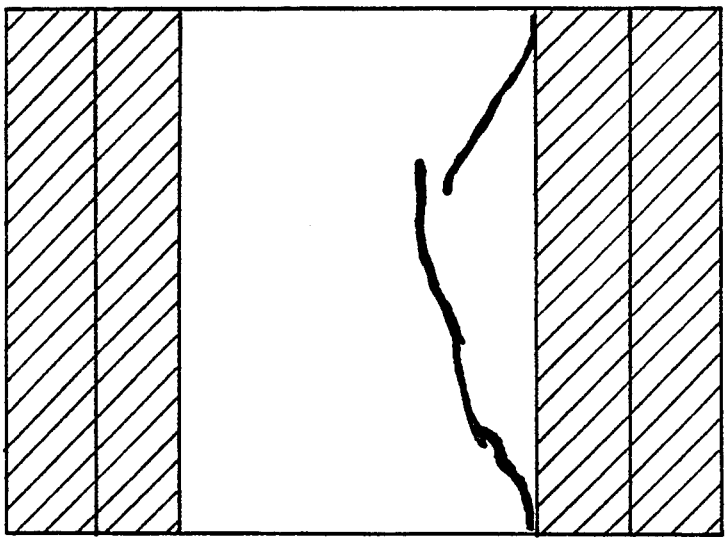
Figure 4A:
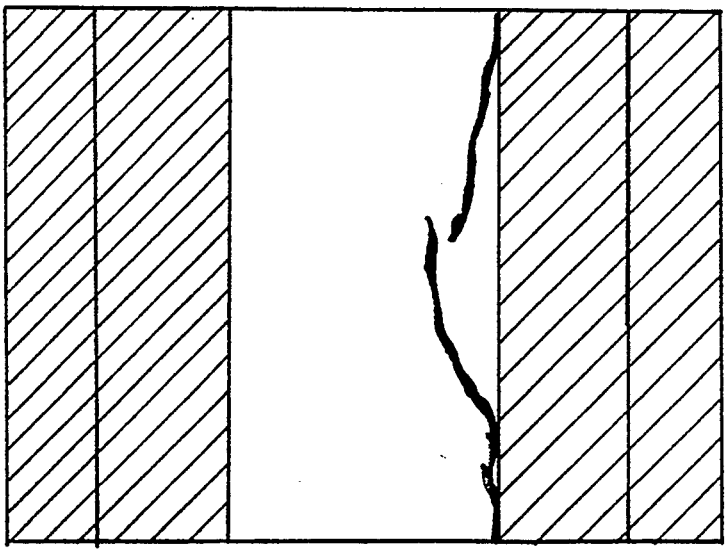
Figure 5C:
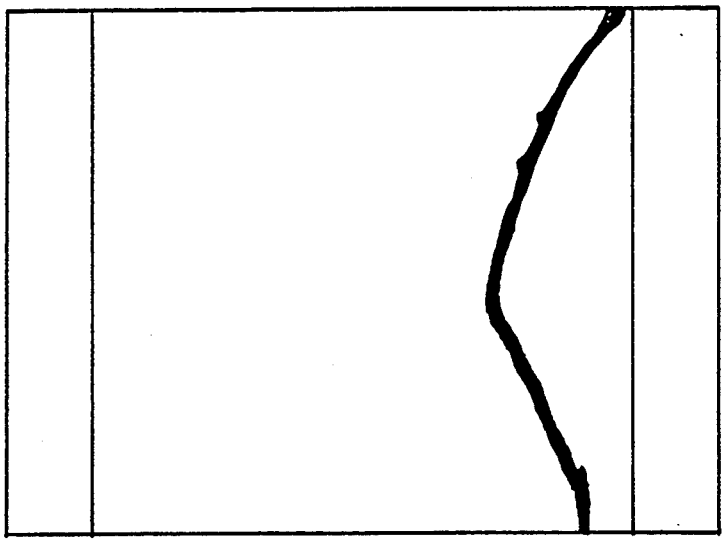
FIGS. 5A to 5C illustrate laminations inside score lines on panels with flaps for various panel constructions, according to the present invention.
Figure 5B:
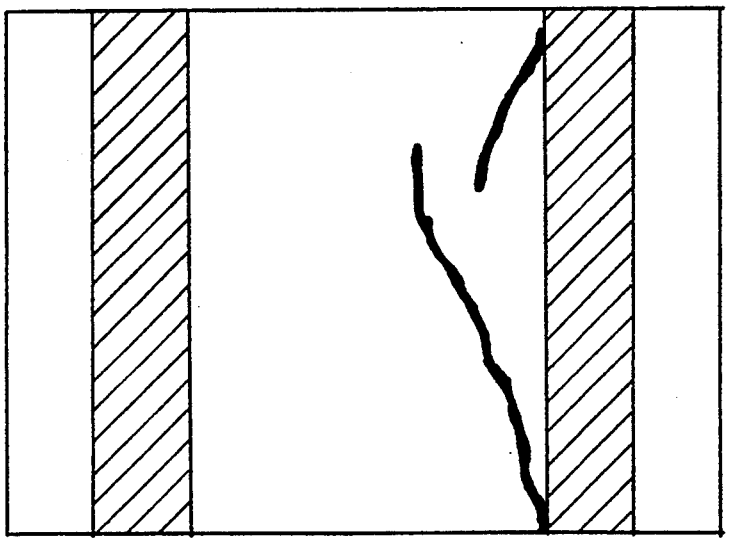
Figure 5A:
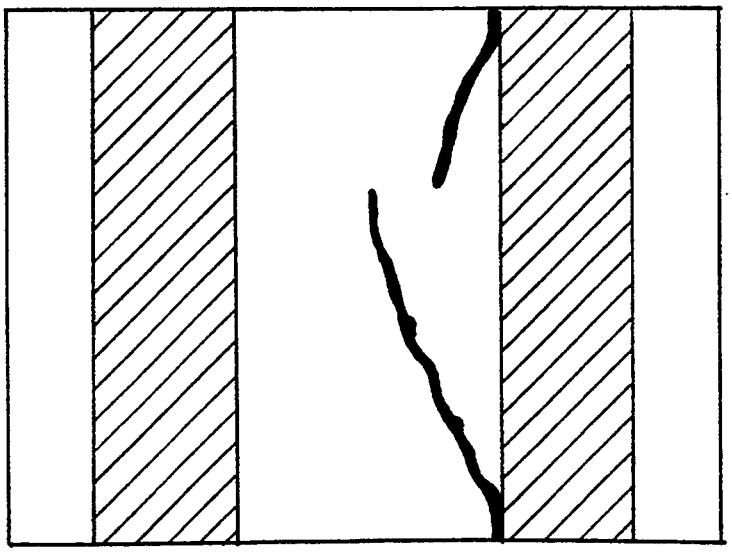
Figure 6C:
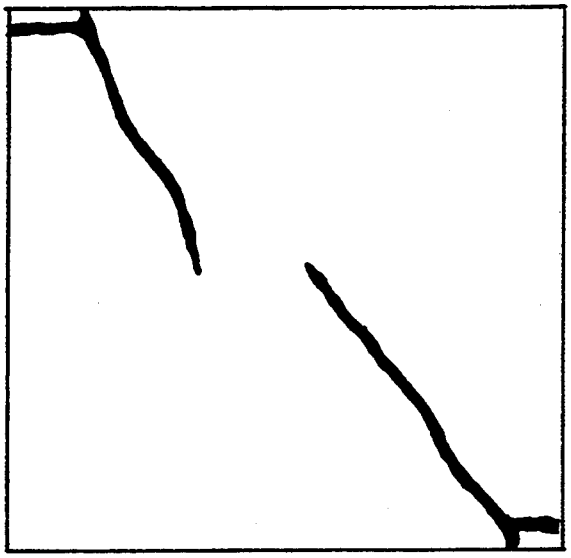
FIGS. 6A to 6C illustrate laminations on panels without flaps for various panel constructions, according to the present invention.
Figure 6B:
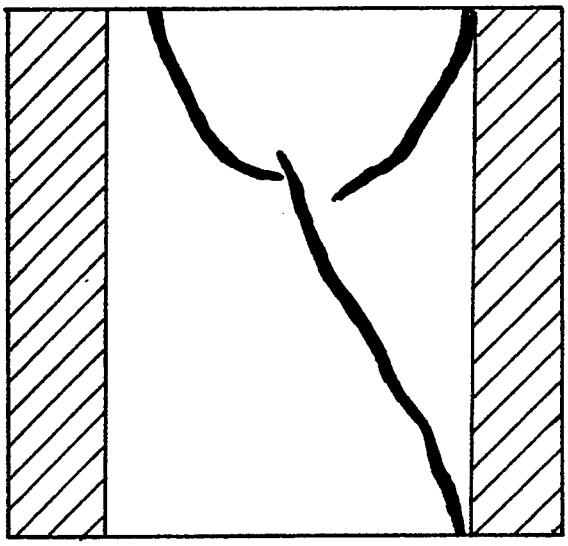
Figure 6A:
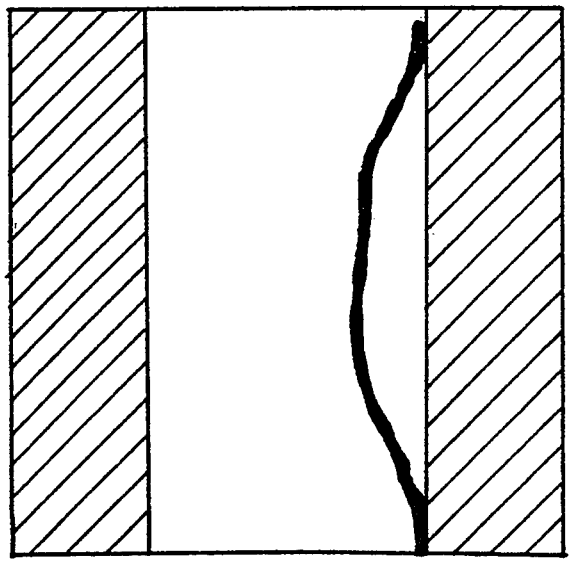
Figure 7B:
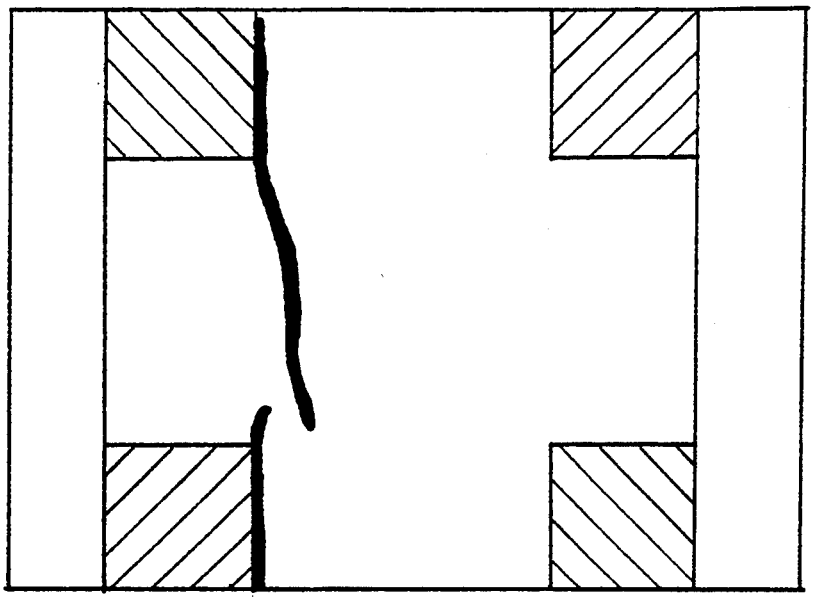
FIGS. 7A and 7B illustrate panels with 3 inch by 3 inch patch laminations on panels without flaps and panels with flaps, respectively, according to the present invention.
Figure 7A:
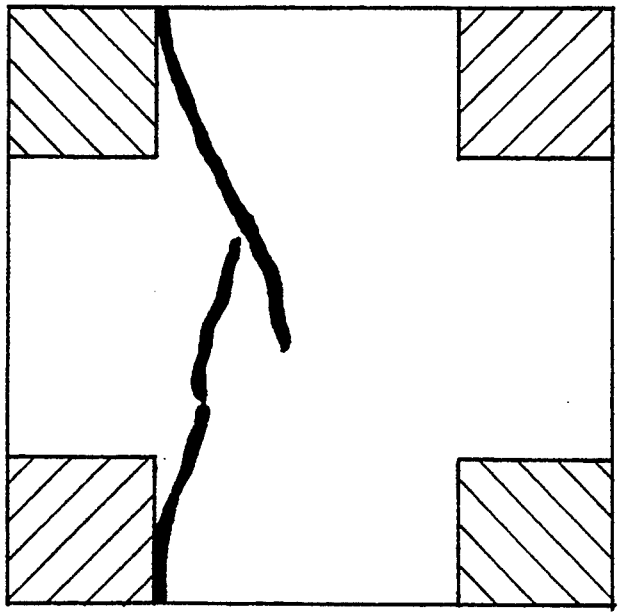

As discussed earlier, laminated linerboard, when placed on the inside of a corrugated box, significantly improves box compressive strength. This confirmed previously observed compressive strength improvements in boxes with unbalanced linerboard combinations. Unbalanced linerboards are more efficient than balanced combinations when the side with the heaviest linerboard is on the inside of the box.

The mechanism of strength improvement by lamination was investigated in a series of tests using panels to simulate performance of corrugated board in a box. Full width laminations of 42 lbm/Msf and 69 lbm/Msf linerboards came from a corrugator trial. Partial laminations of strips and patches were made with 42 lbm/Msf linerboard on a typical 42/26A/42 control board.

As shown in FIG. 1, panels 2 were prepared with laminations 4 and score lines 6. The laminations 4 were laminated both across score lines 6 and just inside score lines 6, as shown in FIGS. 1B and 1C. The partial laminations were chosen to cover the areas of panels 2 where the highest compressive stress is shown to occur. Laminations 4 across the score lines separated the effect of load transfer at score lines 6 from reinforcement of high stress areas.

Panels 2 made with full width laminated linerboards are 13–28% stronger than the strength of the control boards, as shown below in Table 1.

TABLE 1

| | Panels (12 × 12 in.) Without Flaps | With Flaps | Box 18 × 12 × 12 in. |
|---|---|---|---|
| Control: 42/26A/42 | | | |
| Strength | 24.3 (0.34) | 21.7 (2.45) | 13.6 |
| Relative Strength | 1.00 | 1.00 | 1.00 |
| Specific Strength | 6.71 | 5.99 | 3.76 |
| Linerboard Laminated on Double-face Side: 42-42/26A/42 | | | |
| Strength | 28.8 (0.64) | 24.6 (0.88) | 22.9 |
| Relative Strength | 1.19 | 1.13 | 1.69 |
| Specific Strength | 6.18 | 5.27 | 4.91 |
| 69-42/26A/42 | | | |
| Strength | 32.1 (0.92) | 27.7 (1.52) | 25.3 |
| Relative Strength | 1.32 | 1.28 | 1.86 |
| Specific Strength | 5.93 | 5.11 | 4.67 |

Strength has units of lbf/in.
95% confidence intervals are listed in parentheses.
Specific strength has units of Knm/kg (compressive strength index).
All failures occurred on the laminated side.

Panels 2 tested without flaps have 11–14% greater strengths than panels with flaps.

Partial lamination test results showed that compressive strength obtained with a full width 42 lbm/Msf lamination is met or exceeded with strips laminated just inside the flap score lines or patches placed in the panel corners, as shown below in Table 2.

TABLE 2

| | Strength | Relative Strength |
|---|---|---|
| Panels Tested With Flaps | | |
| Control: - 42/26A/42 | 21.7 (2.45) | 1.00 |
| Full Laminations | | |
| 42# Linerboard | 24.6 (0.88) | 1.13 |
| 69# Linerboard | 27.7 (1.52) | 1.28 |
| Strip and Patch Laminations Across Score lines: | | |
| 2 inches on Panel | 22.2 (2.83) | 1.02 |
| 3 inches on Panel | 24.1 (1.19) | 1.11 |
| Inside Score lines: | | |
| 2 inches on Panel | 24.4 (0.97) | 1.12 |
| 3 inches on Panel | 26.5 (0.55) | 1.22 |
| 3 by 3 inch Patches: | 25.7 (0.80) | 1.18 |
| Panels Without Flaps: | | |
| Control - 42/26A/42: | 25.9 (0.83) | 1.00 |
| Strip and Patch Laminations | | |
| 2 inch Strip: | 23.9 (0.59) | 0.92 |
| 3 inch Strip: | 27.2 (1.40) | 1.05 |
| 3 by 3 inch Patches: | 27.4 (0.98) | 1.06 |
| | 26.8 (1.45) | 1.03 |

Strength has units of lbf/in.
95% confidence intervals are listed in parentheses.
All failures occurred on the laminated side.

Panels with full width 42 lbm/Msf and 69 lbm/Msf laminations have 13 and 28% higher compressive strengths, respectively, than the control. Panels made with 2 inch and 3 inch strips of 42 lbm/Msf linerboard laminated just inside the flap score lines have 12 and 22% higher compressive strengths than the control. Panels with 3 inch by 3 inch patches in the panel corners have 18% higher strength than the control.

Failure crease locations in panels with partial laminations and controls are shown in FIGS. 3–7. Creases always occurred at the edge of the lamination. The laminations displaced the failure crease towards the center of the panel.

Comparisons of the test results from panels with and without flaps show that the load transfer into the panel through the score line can have a greater effect on compressive strength than laminations in the panel areas with highest stresses. The shift in the failure crease location resulted in a small change in strength (5%) based on the performance of the panels without flaps.

For the panels tested with flaps, when the lamination crossed the score line, strength improvement is 11% for a three inch coverage on the panel. This shows that the lamination acted to suppress failure in the panel and improved load transfer at the score line. A full width lamination of 42 lbm/Msf paperboard increased panel strength 2% over partial lamination across the score line. Laminations just inside the flap score lines suppressed compressive failure in the panel and improved load transfer at the score line. The 3 inch strip lamination produced a 22% increase in strength while the patch produced an increase of 18%.

Figure 8A:
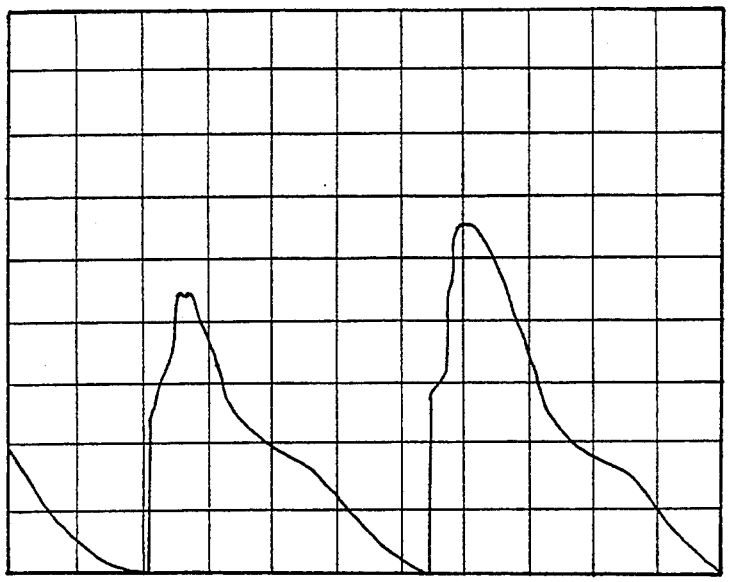
FIGS. 8A to 8C are graphical illustrations of load deflection curves for full width laminations which coincide with FIGS. 3A to 3C, respectively, according to the present invention.
Figure 8B:
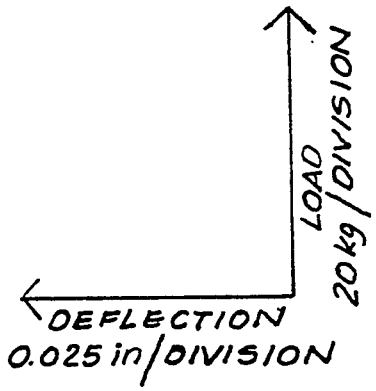
Figure 8B:
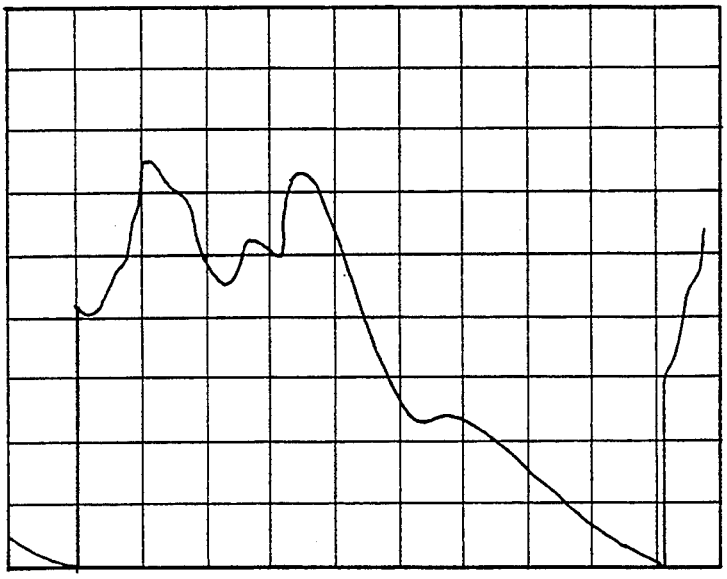
Figure 8C:
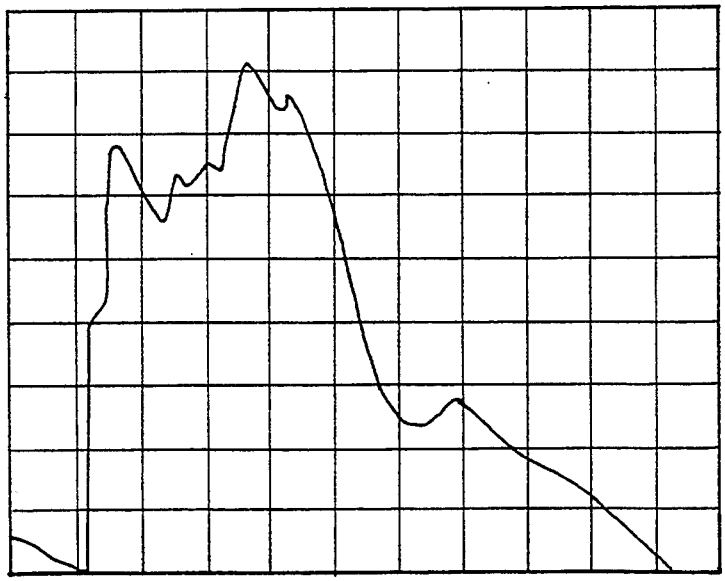
Figure 9A:
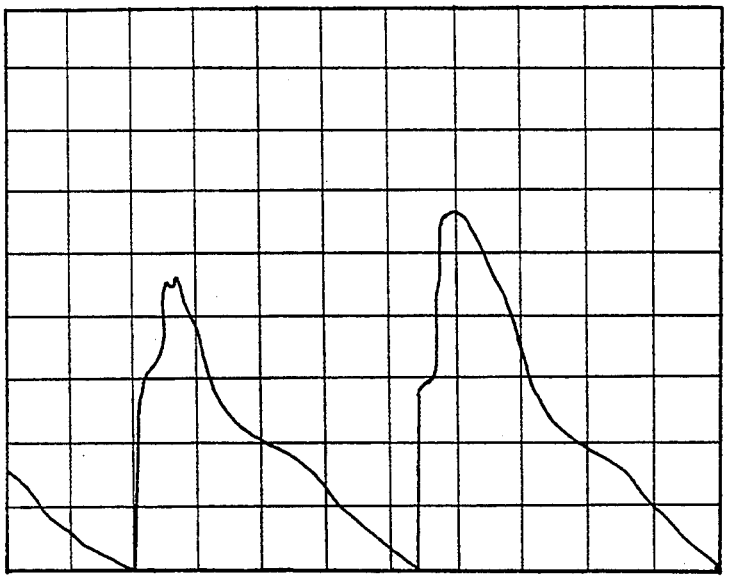
FIGS. 9A to 9C are graphical illustrations of load deflection curves for laminations across score lines which coincide with FIGS. 4A to 4C, respectively, according to the present invention.
Figure 9B:
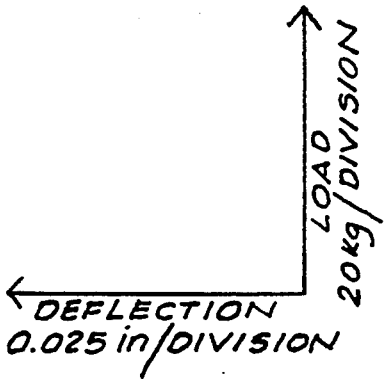
Figure 9B:
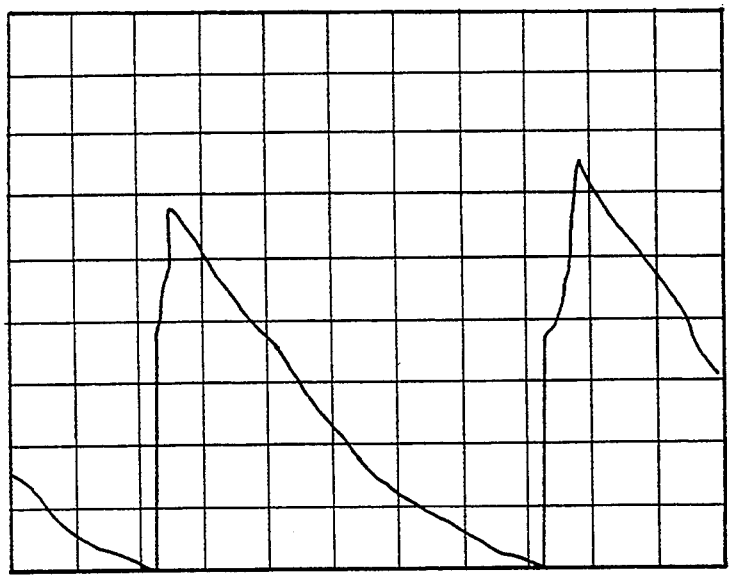
Figure 9C:
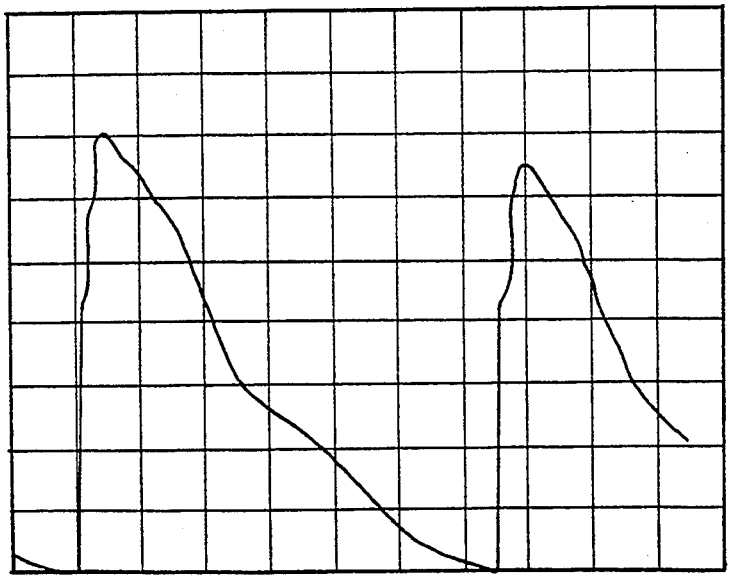
Figure 10A:
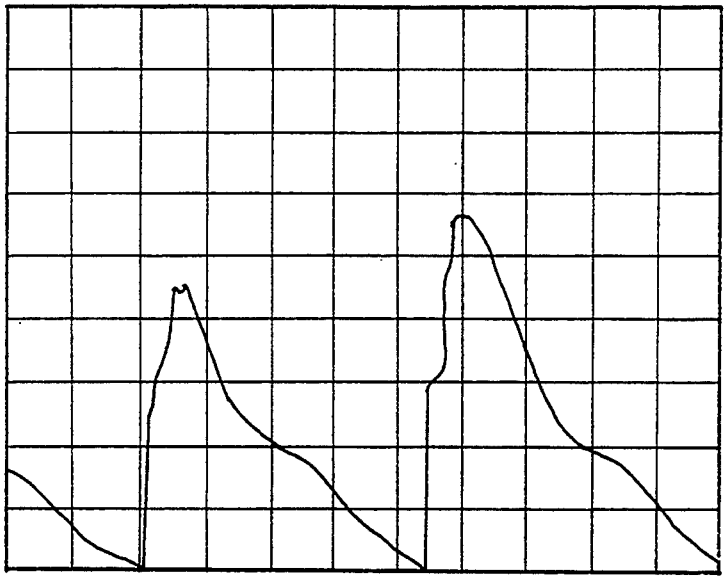
FIGS. 10A to 10C are graphical illustrations of load deflection curves for laminations inside score lines which coincide with FIGS. 5A to 5C, respectively, according to the present invention.
Figure 10B:
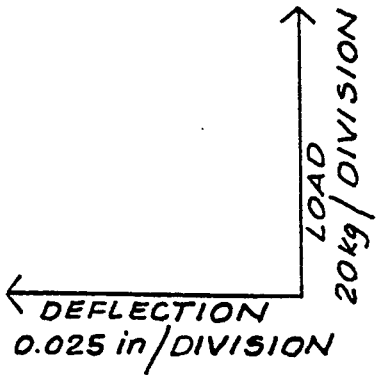
Figure 10B:
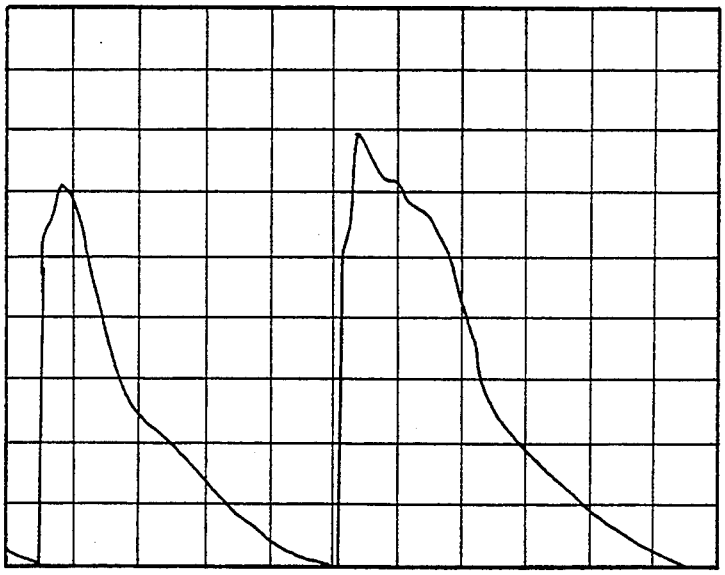
Figure 10C:
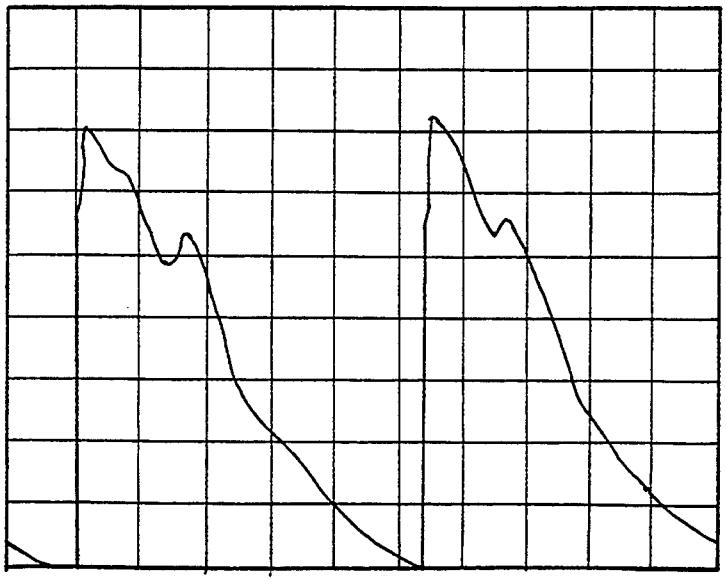
Figure 11A:
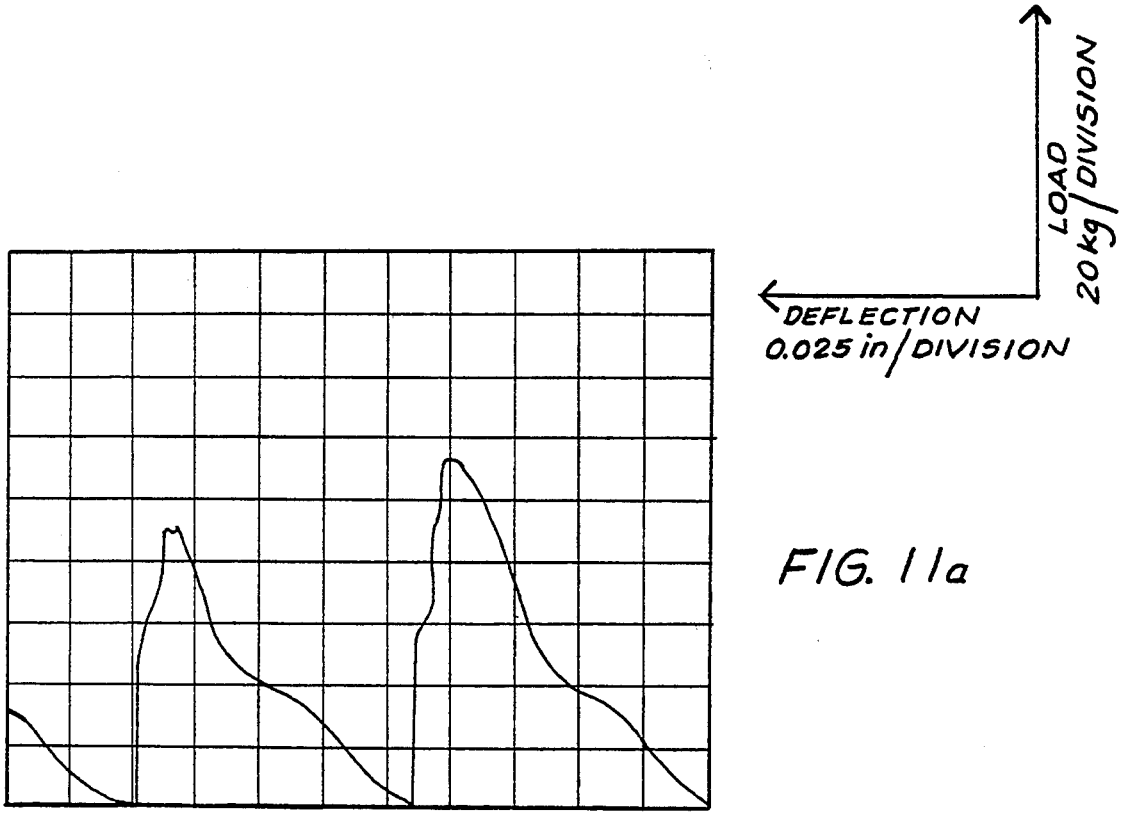
FIGS. 11A and 11B are graphical illustrations of load deflection curves for patch laminations which coincide with FIGS. 7A and 7B, respectively, according to the present invention.
Figure 11B:
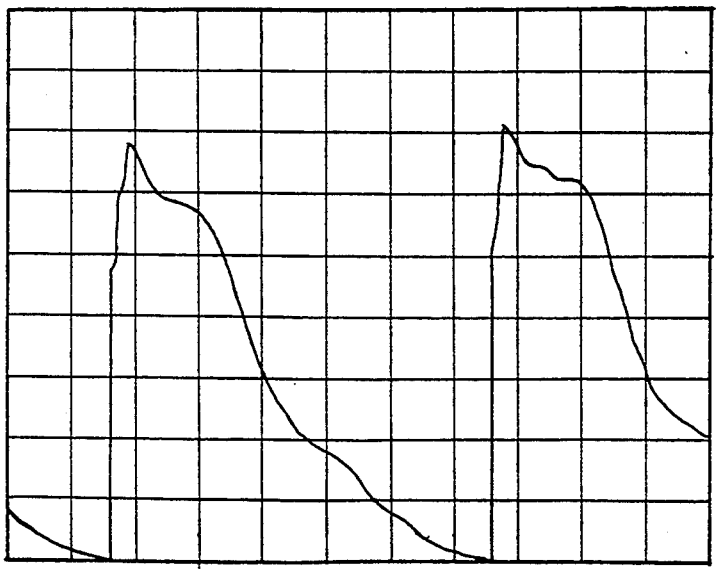

Panels with full laminations had rolling scores and relatively high deflections due to failure, as shown in FIGS. 8*a* to 8*c*. Panels with strip and patch laminations did not have rolling scores. Deflections to failure of these panels are greater than the control, as shown in FIGS. 9 to 11.

Boxes made with the full width laminations are 69–86% stronger than the control. Box strengths are 56–79% of the strengths of panels without flaps and 63–93% of the strengths of panels with flaps. Strengths of panels without flaps should have been greater than box strengths because the panel edges do not impose bending moments. Panels with flaps have edge moments similar to boxes and should have had strengths comparable to the boxes. The boxes have two panels, namely, 12×12 inch panels, which matched the panels with flaps, and two panels that are 18×12 inches.

Using the conventional knowledge that load increases with the square root of the perimeter, box strengths should have been 89% of the strengths of panels with flaps. Consequently, boxes made with full laminations, according to the present invention, attained 91 and 93% of the respective panel strengths.

Finally, boxes were constructed that were selectively reinforced along areas of high stress through laminations with a liner. In addition, the impact of perforated A-scores was examined. The results are presented below in Table 3.

TABLE 3

| | Strength/(S.D.) | Relative Strength |
|---|---|---|
| Control: - 42/26C/42 | 1021 (22) | 1.00 |
| Full Laminations w/42 lb liner | | |
| Inside A-scores | 1271 (68) | 1.24 |
| Including Flaps | 1315 (54) | 1.28 |
| Strip and Patch Laminations Inside A-scores | | |
| 26# liner 2¾" width | 1163 (63) | 1.14 |
| 42# liner 2¾" width | 1148 (97) | 1.12 |
| 69# liner 2¾" width | 1186 (55) | 1.16 |
| 42# liner 1¾" width | 1152 (43) | 1.13 |
| 42# 2¾ × 6" corner patches | 1110 (58) | 1.09 |
| Perforated A-scores | 970 (41) | 0.95 |

Strength units are lbf
Standard deviations are in parentheses
All Boxes 18 × 12 × 12 inches As can be seen from the results of Table 3, full laminations with flaps and laminations between A-scores with 42 lb liner gave 30% increases in Box Compression. Laminations with 2¾" strips of 26 lb liner inside the A-scores gave 14% improvement in Box Compression. Compression strengths were no greater with 42 lb or 69 lb laminations. Perforated A-scores gave no improvement in Box Compression compared to the control with normal scores. The 42 lb laminations having widths of 1¾" and 2¾" gave 13% improvements in Box Compression. Laminations of 6"×3" patches in the corners of the box improved Box Compression by 9%.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A foldable corrugated container, wherein said foldable container is comprised of:

a double-faced corrugated blank having inner and outer sides, a plurality of panels, upper and lower edges, a plurality of flaps located substantially along said upper and lower edges, and first and second score lines such that said first score lines are located substantially parallel to said upper and lower edges and said second score lines are located substantially normal to said upper and lower edges and substantially between said plurality of panels; and first and second paperboard sheet laminations located on said inner side and substantially adjacent to said first and second score lines, away from said first and second edges, and covering a predetermined area of said plurality of panels such that said first and second sheets are located a predetermined distance away from each other and such that said laminations substantially increase a compressive strength of said container.

2. The container, as in claim 1, wherein said laminations are further comprised of:

strips.

3. The container, as in claim 1, wherein said laminations are further comprised of:

patches.

4. The container, as in claim 1, wherein said corrugated blank is further comprised of:

paperboard.

5. A foldable corrugated container, wherein said foldable container is comprised of:

a double-faced corrugated blank having inner and outer sides, a plurality of panels, upper and lower edges, a plurality of flaps located substantially along said upper and lower edges, and first and second score lines such that said first score lines are located substantially parallel to said upper and lower edges and said second score lines are located substantially normal to said upper and lower edges and substantially between said plurality of panels; and first and second paperboard sheet laminations located on said inner side and substantially across said first score lines and adjacent to said second score lines, away from said first and second edges, and covering a predetermined area of said plurality of panels such that said first and second sheets are located a predetermined distance away from each other and such that said laminations substantially increase a compressive strength of said container.

6. The container, as in claim 5, wherein said laminations are further comprised of:

strips.

7. The container, as in claim 5, wherein said laminations are further comprised of:

patches.

8. The container, as in claim 5, wherein said corrugated blank is further comprised of:

paperboard.

* * * * *